US005203242A

United States Patent [19]

Hansson

[11] Patent Number: 5,203,242

[45] Date of Patent: Apr. 20, 1993

[54] POWER TOOL FOR TWO-STEP TIGHTENING OF SCREW JOINTS

[75] Inventor: Gunnar C. Hansson, Stockholm, Sweden

[73] Assignee: Atlas Copco Tools AB, Stockholm, Sweden

[21] Appl. No.: 809,961

[22] Filed: Dec. 18, 1991

[51] Int. Cl.[5] ..... B25B 25/151

[52] U.S. Cl. ..... 81/469; 81/474; 81/57.14

[58] Field of Search ..... 81/467, 469, 473–476, 81/57.14

[56] References Cited

U.S. PATENT DOCUMENTS

| | | | |
|---|---|---|---|
| 3,319,494 | 5/1967 | Ulbing | 81/476 X |
| 3,965,778 | 6/1976 | Aspers et al. . | |
| 4,881,435 | 11/1989 | Hansson . | |
| 4,883,130 | 11/1989 | Dixon | 81/467 X |
| 5,076,120 | 12/1991 | Lin | 81/467 X |

*Primary Examiner*—D. S. Meislin

*Attorney, Agent, or Firm*—Frishauf, Holtz, Goodman & Woodward

[57] ABSTRACT

A power tool for two-step tightening of screw joints by a first high speed step for tightening the screw joint to a predetermined torque snug level ($T_1$) and a second low speed step for tightening the screw joint to a desired final torque level ($T_2$). The power tool (10) includes an electric motor, an output shaft (17), a mechanical power transmission coupling the motor to an output shaft (17), a power supply (11) connected to the motor, signal producing device (16) delivering a signal reflective of the output torque of the tool (10), and a comparator device (19, 23) for comparing the torque reflective signal with predetermined limit values corresponding to the torque snug level and to the desired final torque level and for delivering power shut-off initiating signals as the torque reflective signal attains these limit values. The power tool (10) comprises a torque and speed responsive override clutch (30) for limiting the output torque to a safety torque level ($T_s$) well below the desired final torque level ($T_2$) but exceeding the snug level ($T_1$) in case of an inertia related torque overshoot during the first high speed tightening step. A centrifugal weight (48, 49) operated lock element (45) unlocks the clutch (30) for overriding at speed levels exceeding a predetermined level only. During the second low speed tightening step, the clutch (30) is locked against overriding and transfers torque without limitation.

4 Claims, 3 Drawing Sheets

POWER TOOL FOR TWO-STEP TIGHTENING OF SCREW JOINTS

BACKGROUND OF THE INVENTION

This invention relates to a power tool for two-step tightening of screw joints by a first high speed step for tightening the screw joint to a predetermined torque snug level and a second low speed step for tightening the screw joint to a desired final torque level.

In particular, the invention concerns a screw joint tightening tool with the above operation characteristics and comprising a rotation motor, an output shaft, a mechanical power transmission coupling the motor to the output shaft, and power supply means connected to the motor and including signal producing means for delivering a signal reflective of the output torque of the tool, and means for comparing the torque reflective signal with predetermined limit values corresponding to the torque snug level and the final torque level, respectively, and for delivering power shut-off initiating signals as the torque reflective signal attains these limit values.

Accordingly, the power tool according to the invention is intended to tighten screw joints in two subsequent steps which are both interrupted in response to signals produced as the first step torque snug level and the second step final torque level, respectively, are reached.

Power tools for two-step tightening are previously well known, an example of which is shown and described in U.S. Pat. No. 3,965,778. Although in this example, motor stall is used as a torque snug level indication it is as common to use a torque sensing transducer or other torque sensing signal producing means to initiate interruption of the first tightening step.

A problem concerned with two-step tightening power tools is that when being used on very stiff screw joints, i.e. screw joints with a very steep torque growth in relation to the angle of rotation or time, the inertia of the rotating parts of the tool causes a torque overshoot which even exceeds the desired final torque level to be reached by the second tightening step. This is due to the high rotation speed during the first tightening step and the sudden, steep torque growth in the joint.

Even at tools where the drive motor is braked electrically as the torque snug level is reached in order to absorb the remaining kinetic energy of the rotating parts, there will still be a torque overshoot, because the control system and the motor drive are not fast enough reacting to be able to avoid inertia influence on the torque level attained by the first tightening step.

One solution to this problem might be to employ a torque and speed responsive release clutch in the power transmission of the tool, a clutch that is set to release and limit the power transmission at the torque snug level during the first high speed tightening step but not to release during the second low speed tightening step.

A tool comprising a clutch of this type is described in U.S. Pat. No 4,881,435.

This prior art tool concept, however, brings another problem, namely the addition of a mechanical means that is subject to mechanical wear, which has a negative influence on the torque accuracy and the service life of the tool. It also requires a signal producing means for initiating power shut-off at release of the clutch. Such a signal producing means is mechanically coupled to the clutch and makes the tool undesirably complex.

The main object of the invention is to create a power tool for two-step tightening of screw joints, which tool includes means for initiating shut-off in response to a torque related signal reaching predetermined limit values representing a torque snug level and a final torque level, respectively, and which comprises a safety means for preventing overtightening of very stiff joints.

Another object of the invention is to create a power tool for two-step tightening of screw joints in which both steps are controlled in response to a signal reaching preset limit values representing a torque snug level and a desired final torque level, respectively, and in which a mechanical override safety clutch is arranged to limit the output torque during the first tightening step to a safety level well below the final torque level in cases of very stiff joints only.

This object is achieved by the invention as it is defined in the claims.

A preferred embodiment of the invention is hereinbelow described in detail with reference to the accompanying drawing.

BRIEF DESCRIPTION OF THE DRAWINGS

FIGS. 2 and 3 include schematic illustrations of the clutch teeth arrangement.

DETAILED DESCRIPTION

Figure 4:
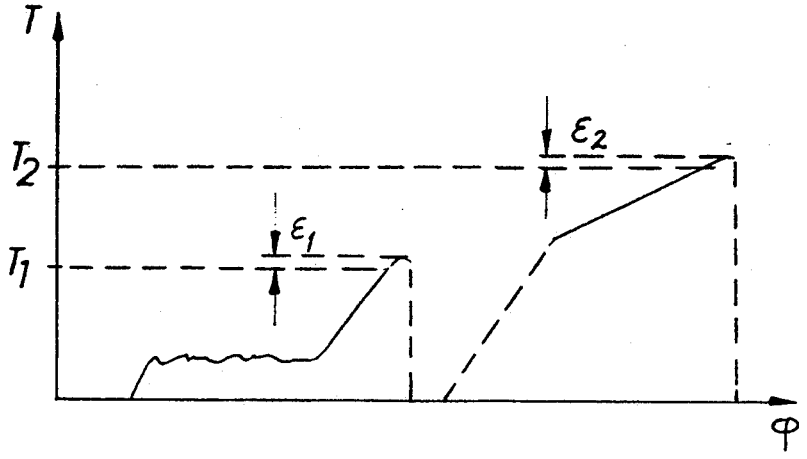
FIG. 4 shows a diagram illustrating a two-step tightening process carried out on a soft or normal screw joint.

As illustrated in FIG. 4, two-step tightening of a soft or normal screw joint is commenced by a first high speed/low torque step intended to bring the screw joint parts firmly together and accomplish an initial pretension in the joint. This is obtained by installing a torque up to a snug level $T_1$ where the torque application power of the tightening tool is shut off. However, due to a certain amount of kinetic energy remaining in the rotating parts of the tool there is caused a small torque overshoot $\epsilon_1$. After a short moment of stand still, the tool is restarted for the low speed/high torque second tightening step. The tool starts rotating as the output torque of the tool reaches the level of the initially installed torque $T_1+\epsilon_1$. At the target torque level $T_2$ the torque application power is shut off, but due to some remaining kinetic energy in the rotating tool parts, there is caused a torque overshoot $\epsilon_2$. This overshoot $\epsilon_2$ is small since the rotation speed is low during the second tightening step.

Figure 5:
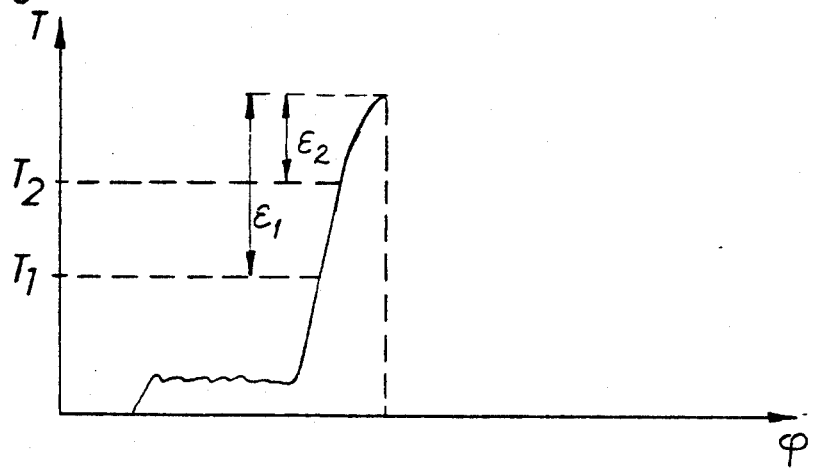
FIG. 5 shows a diagram illustrating a tightening process carried out by a conventional tightening tool on a very stiff joint.
Figure 6:
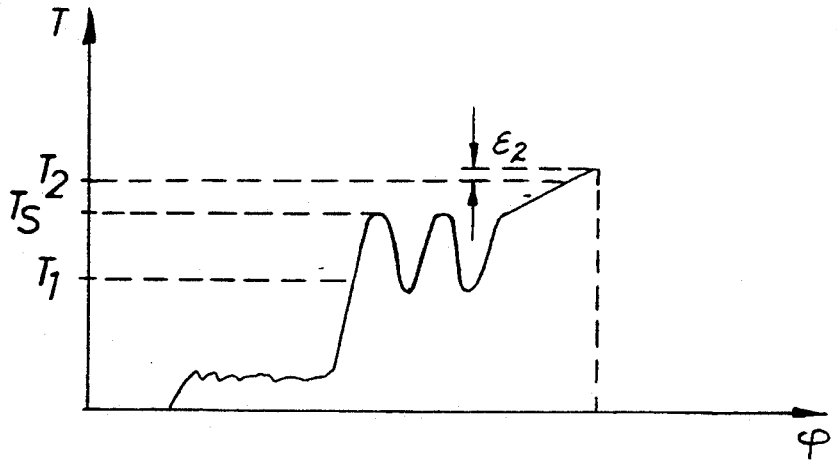
FIG. 6 shows a diagram illustrating a tightening process carried out by a power tool according to the invention on a very stiff joint.

However, if the same tightening tool with the same operating characteristics is used on a very stiff screw joint, i.e. a screw joint having a very steep torque growth in relation to the angle of rotation, the high running down speed in combination with an abrupt growth of the torque resistance in the screw joint results in a large inertia related torque addition $\epsilon_1$ beyond the snug level power shut-off point $T_1$. See FIG. 5. This additional torque or overshoot $\epsilon_1$ is large enough to extend the installed torque even beyond the desired target torque $T_2$ by an overshoot $\epsilon_2$. So, the result is an undesirable torque overshoot $\epsilon_2$ obtained during the first tightening step already.

DETAILED DESCRIPTION OF A PREFERRED EMBODIMENT

Figure 1:
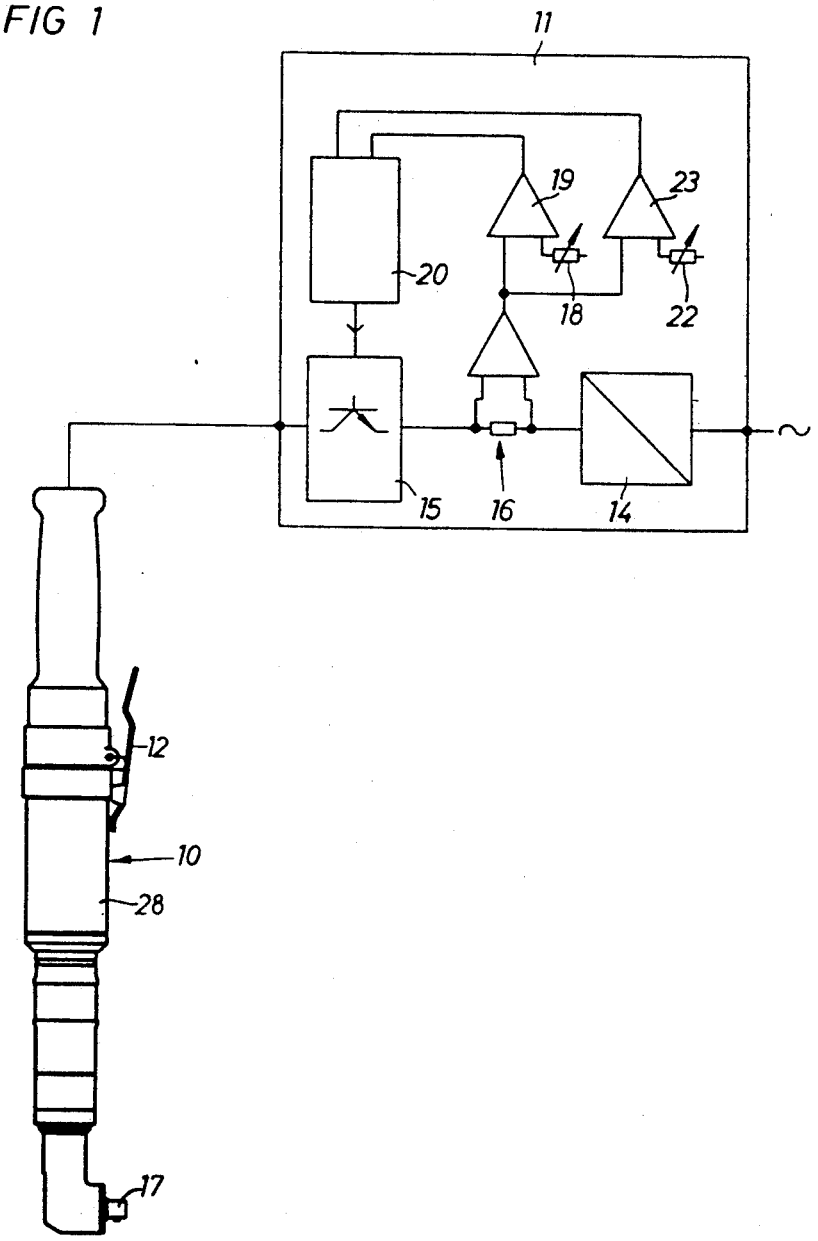
FIG. 1 shows schematically a power tool with power supply means according to the invention.

The tool shown in FIG. 1 is an electrically powered angle nutrunner 10 connected to a supply mains via a power converter 11. The nutrunner 10 comprises a brushless electric rotation motor (not shown) which is supplied with electric power from the power converter 11 via a manouever switch controlled by a lever 12 pivotally mounted on the tool housing 28. The power converter 11 is arranged to deliver an AC current of variable frequency and voltage for obtaining desirable operation characteristics of the nutrunner 10.

The power converter 11 comprises an AC/DC rectifier 14 which is connected to an AC current forming transistor bridge 15 via a current sensing means 16. The latter is arranged to deliver a signal reflective of the DC current which in turn is directly proportional to the torque delivered by the nutrunner motor and the nutrunner output shaft 17.

The power converter 11 also comprises a first torque setting means 18, by which a torque snug level corresponding reference signal is delivered. A comparating means 19 is arranged to compare the torque reflective signal from the current sensing means 16 with this reference signal and to deliver a shut-off initiating signal to an electronic control means 20 as the torque reflective signal equals the reference signal.

A second torque setting means 22 is arranged to deliver a reference signal corresponding to the desired final torque level to be reached by the second tightening step. A comparating means 23 is arranged to compare the output torque reflective signal with the final torque corresponding signal set by the torque setting means 22 and to produce a shut-off signal to the control means 20.

The electronic control means 20 includes a programmable micro computer by which the operational data of the nutrunner motor are determined, for example rotation speed, output torque, start and stopping characteristics etc.

The above description of the power converter 11 is merely schematic, and since the invention is not particularly related to the power converter itself a more detailed description thereof is considered unnecessary. As a matter of fact, a power converter suitable for this purpose may be of a commercially available type like Tensor CC marketed by Atlas Copco.

The nutrunner 10 comprises a mechanical power transmission coupling the motor to the output shaft 17. This power transmission comprises a clutch 30 which is arranged to operate according to two different modes depending on the actual rotation speed. As being apparent from FIGS. 2 and 3, the clutch 30 comprises an input shaft 31 coupled to the motor, a planetary reduction gear 32, and an output shaft 33. The latter is formed as a planet wheel carrier and supports a number of planet wheels 34. The sun wheel of the planetary gear 32 is formed by teeth 36 cut on the input shaft 31, whereas the outer ring gear 37 is a separate ring element rotatively journalled in the tool housing 28 by means of a ball bearing 38.

On its one end, the ring gear 37 is formed with a number of inclined teeth 39 which cooperate with balls 40 axially biassed by springs 41 towards the ring gear 37.

On its opposite end, the ring gear 37 is formed with a number of rectangular teeth 43 which are arranged to cooperate with correspondingly shaped rectangular teeth 44 on a lock ring 45. The latter is axially movable but rotationally locked in the housing 28 by means of splines 46. A compression spring 47 biases the lock ring 45 toward the ring gear 37 engaging position of the latter, whereas two centrifugal weights 48, 49 are pivotally mounted on ears 50, 51 on the input shaft 31 to exert an axial shifting force on the lock ring 45 against the bias action of the spring 47. For that purpose, the centrifugal weights 48, 49 are formed with fingers 52, 53 which transfer the speed related force exerted by the weights 48, 49 to the lock ring 45 via a needle type thrust bearing 54 mounted on the lock ring 45.

Figure 2:
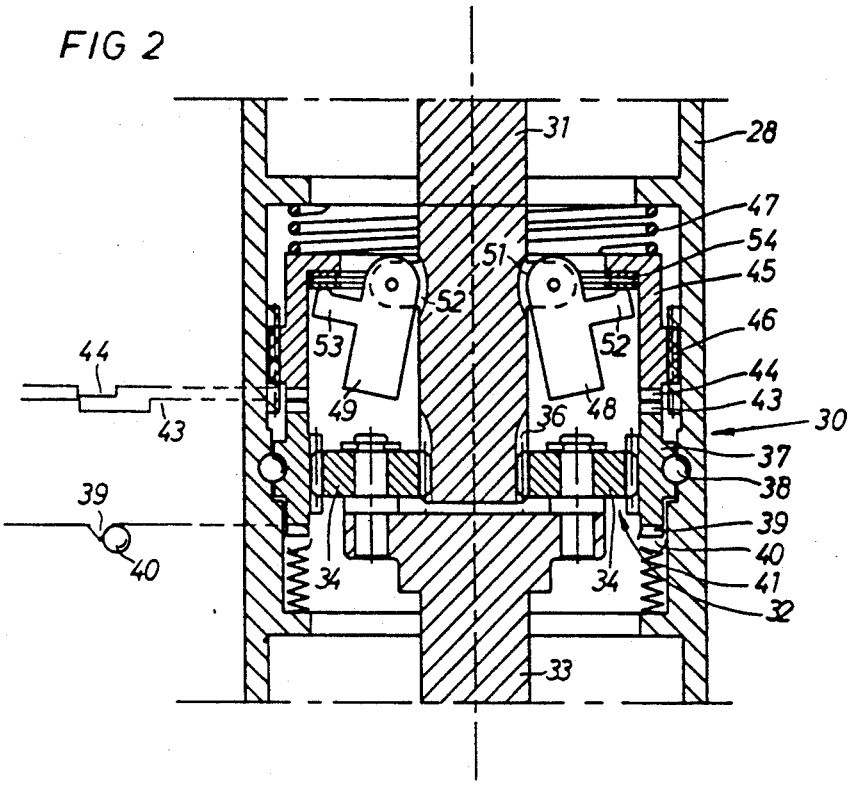
FIG. 2 shows a longitudinal section through a clutch comprised in the power transmission of the power tool. The clutch is shown in its high speed operation mode.

In the high speed operation mode of the clutch 30, illustrated in FIG. 2, the centrifugal action on the weights 48, 49 is large enough to exceed the bias force of the spring 47 and accomplish an axial displacement of the lock ring 45. Thereby, the straight rectangular teeth 44 of the latter are moved out of engagement with the teeth 43 of the ring gear 37, which means that the latter is no longer positively locked against rotation relative to the tool housing 28. See FIG. 2. Now, the ring gear 37 is prevented from rotating by the interengagement of the inclined teeth 39 and the spring biassed balls 40. This condition prevails until the transferred torque and the reaction torque on the ring gear 37 reaches a level where the springs 41 no longer can withstand the force excerted by the inclined teeth 39 on the balls 40. Above that level the teeth 39 of the ring gear 37 overrides the balls 40 and, thereby, the transferred torque is limited to the safety level $T_s$.

Figure 3:
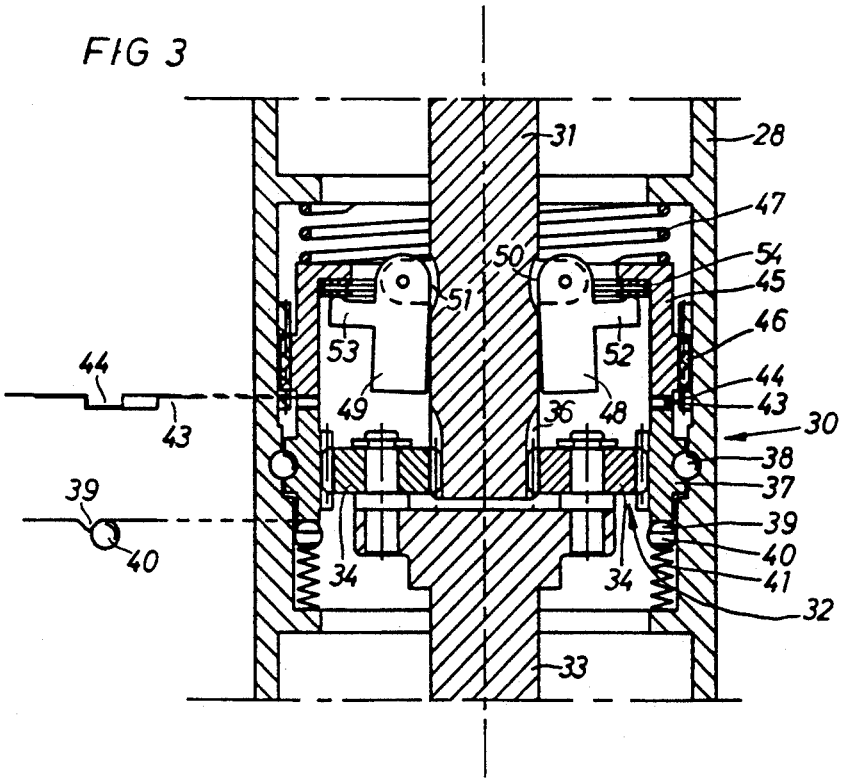
FIG. 3 shows a section similar to that of FIG. 2, but shows the clutch in the low speed operation mode.

In the low speed operation mode of the clutch 30, illustrated in FIG. 3, the centrifugal action of the weights 48, 49 does not exceed the bias force of spring 47, which means that the lock ring 45 remains in its ring gear 37 locking position. In this mode of operation, the clutch is unable to limit the transferred torque since the ring gear 37 is positively locked relative to the housing 28 by rectangular teeth 44, 43 and splines 46.

In a screw joint tightening application, the nutrunner 10 is connected on one hand to the screw joint by means of a nut socket attached to the output shaft 17 and on the other hand to a source of electric power via the power converter 11. The tightening operation starts as the manouever lever 12 is pressed by the operator and a starting signal is sent to the control means 20. According to the program of the control means 20, the first high speed tightening step now commences. As the screw joint is threaded down and the parts to be clamped together by the joint are brought into firm contact with each other, the torque resistance in the joint starts rising and reaches very soon the torque snug level $T_1$. This is indicated by the comparating means 19 which delivers a shut-off signal to the control means 20 as the torque reflective signal produced by the current sensing means 16 equals the preset reference signal delivered by the first torque setting means 18. The first tightening step is completed.

If, however, the screw joint to be tightened is very stiff, i.e. a very steep torque growth in relation to time or angle of rotation, the torque snug level $T_1$ is reached very suddenly without the rotating parts of the nutrunner 10 having been retarded from their high speed during running down. This means that the inertia of the rotating parts tends to extend the tightening movement of the joint not only beyond the snug level shut-off point $T_1$ but also beyond the desired final torque level $T_2$ by an overshoot $\epsilon_2$. See FIG. 5.

In such cases, the rotating parts of the nutrunner 10 are prevented by the clutch 30 from causing an undesirable final torque overshoot, because in the high speed operating mode of the clutch 30, illustrated in FIG. 2, the centrifugal weights 48, 49 have shifted the lock ring 45 to the ring gear 37 unlocking position. In that position of the lock ring 45, the ring gear 37 may rotate in the housing 28 when the preset engagement force between the inclined teeth 39 and the balls 40 is exceeded. This engagement force is set to correspond to an output torque level of the nutrunner some 20% below the final torque level $T_2$, which means that if the kinetic energy of the rotating parts of the nutrunner is high enough to cause an extended rotation beyond the snug level point $T_1$, the clutch 30 will override and limit the output torque to a safety level $T_s$ well below the desired final torque level. On the other hand, the safety torque level $T_s$ is set well above the snug level $T_1$ to ensure that the clutch 30 will not release in other cases than those of very stiff joint.

Thus, the clutch 30 acts a safety means which comes into operation in those cases only where the joint to be tightened has a very steep torque/rotation characteristic. In all other cases, the clutch remains inactive, which means that the override means, i.e. inclined teeth 39 and balls 40, are not exposed to any mechanical wear.

After a completed first tightening step, including overriding of the clutch 30 or not, the second tightening step is commenced. See FIG. 4. Now, the rotation speed does not exceed the level where the centrifugal weights 48, 49 are able to displace the lock ring 45 against the spring 47 and, thereby, enable overriding of ring gear 37. This means that the clutch 30 remains in its locked low speed operation mode, as illustrated in FIG. 3, so as to permit tightening to the desired final torque level $T_2$.

The second tightening step is discontinued as the torque reflective signal from the current sensing means 16 equals the reference signal delivered by the second torque setting means 22, and a power shut off signal is sent from the comparating means 23 to the control means 20.

In the above described example, the actual output torque of the nutrunner is sensed by a current sensing means 16 disposed in the DC current circuit of the power converter 11. It is to be noted, however, that the invention is as well applicable in connection with power converters connected to an external torque sensing means, for example a torque transducer mounted on the nutrunner.

It is important also to note that the basic concept of the invention does not limit the embodiments to a dual mode clutch having the lock ring operated by centrifugal weights. The lock ring could as well be operated by an electromagnetic solenoid connected to the control unit such that the lock ring is lifted to the clutch release mode position as long as the motor speed exceeds a certain value. Speed sensing and solenoid activation is carried out entirely within the power converter.

We claim:

1. A power tool for two-step tightening of screw joints, the two steps comprising a first high speed tightening step for tightening a screw joint to a predetermined torque snug level ($T_1$), and a second low speed tightening step for tightening the screw joint to a desired final torque level ($T_2$), said power tool comprising:

a housing (28);

a rotation motor in said housing;

an output shaft (17);

a mechanical power transmission coupling said rotation motor to said output shaft (17);

power supply means (11) coupled to said rotation motor;

signal producing means (16) for delivering a signal reflective of the output torque of the power tool (10); and means (19, 23) for comparing said torque reflective signal with predetermined limit values corresponding to said torque snug level ($T_1$) and to said final torque level ($T_2$), and for delivering power shut-off initiating signals as said torque reflective signal attains said predetermined limit values;

said mechanical power transmission including:

a planetary reduction gear (32) including a ring gear;

a torque and speed responsive override clutch (30) which comprises said ring gear (37) of said planetary reduction gear (32), said ring gear (37) being rotatably supported in said housing (28) and exposed to a reaction torque as said reduction gear (32) transfers torque;

a yieldable cam means (39, 40) for transferring to said housing (28) said reaction torque from said ring gear (37) up to a level corresponding to a safety torque level ($T_s$) substantially below said final torque level ($T_2$);

a speed responsive lock means (45) arranged to release said ring gear (37) for rotation relative to said housing during said first high speed tightening step and to positively lock said ring gear (37) against rotation relative to said housing (28) during said second low speed tightening step;

said lock means comprises an activation means (48, 49) for locking and releasing said ring gear (37); and a lock ring (45) shiftable by said activation means (48, 49) from a ring gear (37) locking position to a ring gear (37) releasing position.

2. The power tool of claim 1, wherein said activation means (48, 49) comprises:

a centrifugal force operated activation means.

3. The power tool of claim 2, wherein said lock ring (45) comprises a spring biased lock ring.

4. The power tool of claim 1, wherein said lock ring (45) comprises a spring biased lock ring.

* * * * *